US009731527B2

(12) United States Patent
Hoshii

(10) Patent No.: US 9,731,527 B2
(45) Date of Patent: Aug. 15, 2017

(54) LIQUID DROPLET DISCHARGING APPARATUS AND LIQUID DROPLET DISCHARGING METHOD

(71) Applicant: SEIKO EPSON CORPORATION, Tokyo (JP)

(72) Inventor: Jun Hoshii, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/297,677

(22) Filed: Oct. 19, 2016

(65) Prior Publication Data

US 2017/0120641 A1 May 4, 2017

(30) Foreign Application Priority Data

Nov. 2, 2015 (JP) ..... 2015-215513

(51) Int. Cl.

| | |
|---|---|
| ***B41J 11/00*** | (2006.01) |
| ***B41J 25/00*** | (2006.01) |
| *B41J 13/00* | (2006.01) |
| *B41J 11/42* | (2006.01) |

(52) U.S. Cl.
CPC ..... *B41J 25/006* (2013.01); *B41J 11/42* (2013.01); *B41J 13/0009* (2013.01)

(58) Field of Classification Search
CPC ..... B41J 25/006; B41J 25/001; B41J 25/14; B41J 11/42
See application file for complete search history.

(56) References Cited

U.S. PATENT DOCUMENTS 9,522,554 B2 * 12/2016 Baba ..... G06K 15/107
2010/0079527 A1 * 4/2010 Sanada ..... B41J 2/2132 347/14

FOREIGN PATENT DOCUMENTS

JP 2010-017976 A 1/2010

* cited by examiner

*Primary Examiner* — Thinh H Nguyen
(74) *Attorney, Agent, or Firm* — Global IP Counselors, LLP

(57) ABSTRACT

Each pass is configured such that liquid droplet discharging characteristics of each pass are not superimposed, and when an average number of pass operations which are necessary in formation of dot rows lined up in a main scanning direction is x, k<x<k+1.

6 Claims, 14 Drawing Sheets

LIQUID DROPLET DISCHARGING APPARATUS AND LIQUID DROPLET DISCHARGING METHOD

BACKGROUND

1. Technical Field

The present invention relates to a liquid droplet discharging apparatus which performs multi-pass printing and a liquid droplet discharging method therefor.

2. Related Art

As an example of a liquid droplet discharging apparatus, an ink jet printer is known which performs image recording (printing) by discharging ink droplets toward various recording mediums such as a paper sheet and a film to form a plurality of dots on the recording medium. For example, in a case where the ink jet printer is a serial printer, with respect to the recording medium, the ink jet printer alternately repeats a dot formation operation (pass) which forms dot rows (raster line) lined up in a main scanning direction of the recording medium by discharging ink droplets from a plurality of nozzles while moving (scanning) a head on which the plurality of nozzles are formed in the main scanning direction, and a sub-scanning operation which moves (transports) the recording medium in a sub-scanning direction which intersects with the main scanning direction. Thereby, dots are lined up without gaps in the main scanning direction and the sub-scanning direction of the recording medium, and an image is formed on the recording medium.

For such an ink jet printer, a technique is known in which the quality of a recorded image is improved by an increase in the number of passes. In JP-A-2010-17976, an image formation method is suggested which divides a printing region according to the density of an image to be recorded on the recording medium, and prints the image while changing the number of scans for each portion of the printing region.

In the image formation method of JP-A-2010-17976, there are cases where it is possible to make unevenness inconspicuous by raising the number of passes for a region in which unevenness is conspicuous. However, a pass superimposing method that further improves image quality is not particularly considered. That is, in a case where the number of passes is raised, there is a problem that unevenness may be generated depending on dot formation characteristics in each pass and a superimposing method of each pass (setting method of a region in which each pass is overlapped).

SUMMARY

The invention can be realized in the following application examples or aspects.

APPLICATION EXAMPLE 1

According to this application example of the invention, there is provided a liquid droplet discharging apparatus including a head which has nozzles which discharge liquid droplets on a recording medium, a main scanning unit which performs a main scanning operation which relatively moves the head with respect to the recording medium in a main scanning direction, and a sub-scanning unit which performs a sub-scanning operation which relatively moves the recording medium with respect to the head in a sub-scanning direction which intersects with the main scanning direction, in which an image consisting of a plurality of dot rows is formed on the recording medium by repetition of pass operations which form dot rows lined up in the main scanning direction by discharging the liquid droplets on the recording medium from the nozzles during the main scanning operation and the sub-scanning operation, the nozzles are lined up in a predetermined direction which intersects with the main scanning direction to configure a nozzle row, and when a proportion of positions for which discharge of the ink droplets is possible to positions to which each nozzle can discharge the liquid droplets in one pass operation is a nozzle usage rate, the maximum nozzle usage rate in formation of the image is a maximum nozzle usage rate, a length between nozzles at both ends in the sub-scanning direction in the nozzles which configure the nozzle row is Lh, a length by which the recording medium is relatively moved in one sub-scanning operation is d, a length in the sub-scanning direction of an arrangement of consecutive nozzles with the maximum nozzle usage rate in the nozzles which configure the nozzle row is Lt, and n is a natural number, in the pass operation with respect to a predetermined region except an end portion region of the recording medium, $Lt=4\times d\times n-Lh$.

It is considered that one reason for unevenness confirmed in a completed image is synthesis of influences of uneven components in an image which is formed by each pass operation. For example, in a case where a relationship between the nozzle usage rate and density of the formed image is not a linear relationship, unevenness may become apparent as a result of influences of this being superimposed in a plurality of pass operations.

According to the application example, in the relationship of $Lt=4\times d\times n-Lh$, appearance of periodic unevenness by uneven components in each pass operation being superimposed is further suppressed with a length d by which the recording medium is relatively moved in one sub-scanning operation and n being appropriately set, and since the respective uneven components are overlapped so as to cancel each other out, it is possible to obtain a printed matter in which visually recognizable unevenness is further reduced.

APPLICATION EXAMPLE 2

In the liquid droplet discharging apparatus according to the application example, when k is a natural number and an average number of pass operations which are necessary in formation of the dot rows lined up in the main scanning direction in the predetermined region is x, $k<x<k+1$.

According to the application example, appearance of periodic unevenness by uneven components in each pass operation being superimposed is further suppressed with a length d by which the recording medium is relatively moved in one sub-scanning operation and n being set such that $k<x<k+1$, and since the respective uneven components are overlapped so as to cancel each other out, it is possible to obtain a printed matter in which visually recognizable unevenness is further reduced.

APPLICATION EXAMPLE 3

In the liquid droplet discharging apparatus according to the application example, when the minimum nozzle usage rate in formation of the image is a minimum nozzle usage rate, a nozzle usage rate of the nozzles at the both ends is the minimum nozzle usage rate.

According to the application example, the nozzle usage rate of the nozzles at both ends in the sub-scanning direction in the nozzles which configure the nozzle row is the minimum nozzle usage rate. In this case, it is possible to suppress the influence of a feeding error in the sub-scanning operation on an end portion region of the image that is formed in each pass operation in which the influence of the feed error tends to become apparent. As a result, it is possible to obtain a printed matter in which visually recognizable unevenness is further reduced.

APPLICATION EXAMPLE 4

The liquid droplet discharging apparatus according to the application example further includes a plurality of the nozzle rows, in which the nozzle rows are provided at positions which are different from each other in the sub-scanning direction.

As in such an application example, the liquid droplet discharging apparatus may be provided with a plurality of nozzle rows.

APPLICATION EXAMPLE 5

According to this application example of the invention, there is provided a liquid droplet discharging method including forming an image consisting of a plurality of dot rows on a recording medium by repeating a pass operation, which forms dot rows lined up in a main scanning direction by discharging liquid droplets on the recording medium from nozzles during a main scanning operation which relatively moves a head that has the nozzles which discharge the liquid droplets on the recording medium with respect to the recording medium in the main scanning direction, and a sub-scanning operation which relatively moves the recording medium with respect to the head in a sub-scanning direction which intersects with the main scanning direction, in which the nozzles are lined up in a predetermined direction which intersects with the main scanning direction to configure a nozzle row, and when a proportion of positions for which discharge of the ink droplets is possible to positions to which each nozzle can discharge the liquid droplets in one pass operation is a nozzle usage rate, a maximum nozzle usage rate in formation of the image is a maximum nozzle usage rate, a length between nozzles at both ends in the sub-scanning direction in the nozzles which configure the nozzle row is Lh, a length by which the recording medium is relatively moved in one sub-scanning operation is d, a length in the sub-scanning direction of an arrangement of consecutive nozzles with the a maximum nozzle usage rate in the nozzles which configure the nozzle row is Lt, and n is a natural number, in the pass operation with respect to a predetermined region except an end portion region of the recording medium, $Lt=4\times d\times n-Lh$.

Unevenness which is confirmed in a completed image appears as a result of synthesis of influences of uneven components of an image which is formed by each pass operation. For example, in a case where a relationship between the nozzle usage rate and density of the formed image is not a linear relationship, unevenness may become apparent as a result of influences of this being superimposed in a plurality of pass operations.

According to the application example, in the relationship of $Lt=4\times d\times n-Lh$, appearance of periodic unevenness by uneven components in each pass operation being superimposed is further suppressed with a setting length d by which the recording medium is relatively moved in one sub-scanning operation being appropriately set and n, and since the respective uneven components are overlapped so as to cancel each other out, it is possible to obtain a printed matter in which visually recognizable unevenness is further reduced.

APPLICATION EXAMPLE 6

In the liquid droplet discharging method according to the application example, when k is a natural number and an average number of pass operations which are necessary in formation of the dot rows lined up in the main scanning direction in the predetermined region is x, $k<x<k+1$.

According to the application example, appearance of periodic unevenness by uneven components in each pass operation being superimposed is further suppressed with a length d by which the recording medium is relatively moved in one sub-scanning operation and n being set such that $k<x<k+1$, and since the respective uneven components are overlapped so as to cancel each other out, it is possible to obtain a printed matter in which visually recognizable unevenness is further reduced.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiments of the invention will be described below in detail with reference to the drawings. The invention is not limited to one embodiment of the invention below. Note that, in each of the drawings below, there are cases where for ease of understanding of the explanation a scale is described which is different from in reality.

Embodiment 1

Figure 1:
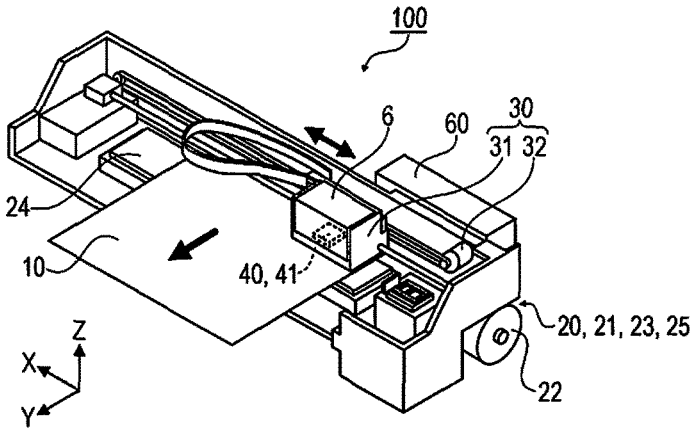
FIG. 1 is a perspective view illustrating an internal configuration of an ink jet printer as a liquid droplet discharging apparatus according to Embodiment 1.
Figure 2:
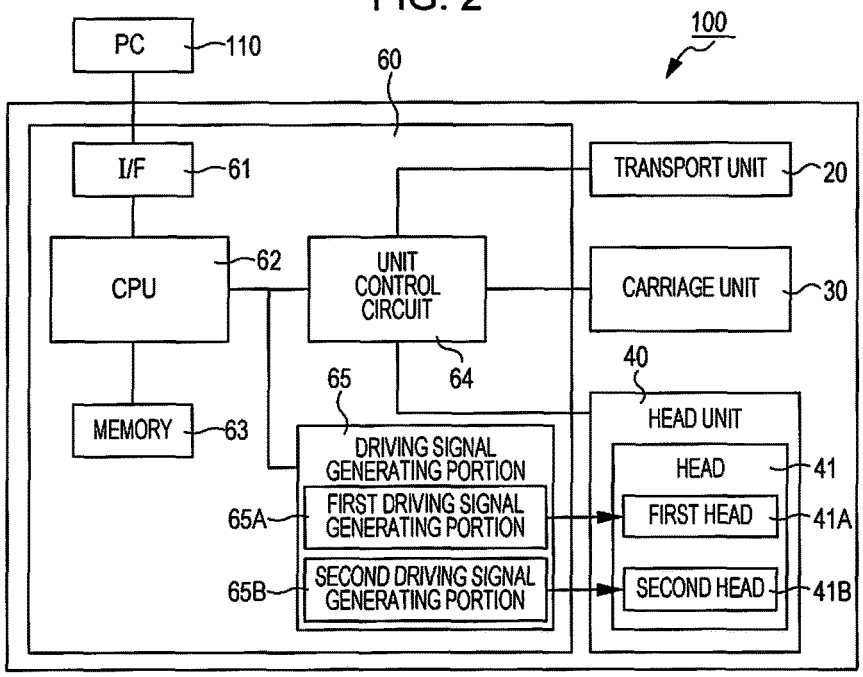
FIG. 2 is a block diagram illustrating the entire configuration of the ink jet printer as a liquid droplet discharging apparatus according to Embodiment 1.

FIG. 1 is a perspective view illustrating an inside configuration of an ink jet printer 100 as a liquid droplet discharging apparatus according to Embodiment 1, and FIG. 2 is a block diagram.

Note that, in XYZ axes in supplemental diagrams, the ink jet printer 100 is installed on an X-Y horizontal plane. In addition, a main scanning direction is described later as a ±X direction (X axis direction), a sub-scanning direction is described later as a +Y direction, and a height direction is described as a Z direction.

First, a basic configuration of the ink jet printer 100 will be described.

Ink Jet Printer Basic Configuration

The ink jet printer 100 (hereinafter, referred to as a printer 100) has a transport unit 20 as a "sub-scanning unit", a carriage unit 30 as a "main scanning unit", a head unit 40, and a controller 60. The printer 100 that receives printing data (image formation data) from a personal computer 110 (hereinafter, referred to as a PC 110) which is an external apparatus controls each unit (transport unit 20, carriage unit 30, and head unit 40) using the controller 60. The controller 60 controls each unit based on printing data that is received from the PC 110 prints an image (image formation) on a paper sheet 10 as a "recording medium".

The transport unit 20 has a function of causing the paper sheet 10 to move in the "sub-scanning direction" which intersects with the "main scanning direction" (a function of performing a "sub-scanning operation", that is, a transport function). The transport unit 20 is provided with a paper feeding roller 21, a transport motor 22, a transport roller 23, a platen 24, a paper discharge roller 25, and the like. The paper feeding roller 21 feeds the paper sheet 10 which is inserted from the rear surface of the printer 100 (−Y side) inside the printer 100. The transport roller 23 transports the fed paper sheet 10 using the paper feeding roller 21 to a region in which printing is possible in an upper portion of the platen 24. The platen 24 supports the paper sheet 10 during printing. The paper discharge roller 25 discharges the paper sheet 10 to the front surface of the printer 100 (sub-scanning direction). The paper feeding roller 21, the transport roller 23, and the paper discharge roller 25 are driven by the transport motor 22.

The carriage unit 30 has a function of causing a head 41 which will be described later to reciprocally move (scan) in a predetermined movement direction (X axis direction illustrated in FIG. 1) as the "main scanning direction". The carriage unit 30 is provided with a carriage 31, a carriage motor 32, and the like. The carriage 31 is able to reciprocally move in the main scanning direction, and is driven by the carriage motor 32. In addition, the carriage 31 holds an ink cartridge 6, which accommodates ink, so as to be attachable and detachable.

The head unit 40 has a function of discharging ink onto the paper sheet 10 as "liquid droplets" (hereinafter, referred to as ink droplets). The head unit 40 is provided with a head 41 which has a plurality of nozzles (nozzle rows). The head 41 is mounted on the carriage 31, and moves in the main scanning direction accompanying movement in the main scanning direction of the carriage 31. A dot row (raster line) is formed (printed) on the paper sheet 10 along the main scanning direction by the ink droplets being discharged while the head 41 is moved in the main scanning direction.

The head 41 is provided with two heads (first nozzle group 41A and second nozzle group 41B). The configuration of the head 41 will be described later.

The controller 60 is a control portion which controls the entirety of the printer 100. The controller 60 is provided with an interface portion 61, a CPU 62, a memory 63, a unit control circuit 64, and the like. The interface portion 61 performs data transfer and reception between the PC 110 and the printer 100. The CPU 62 is an arithmetic processing apparatus for performing control of the entirety of the printer 100. The memory 63 is a storage medium which secures a region in which a program that is operated by the CPU 62 is stored, an operated work region, and the like, and is configured by a memory element such as a RAM, and an EEPROM.

The CPU 62 controls each unit (the transport unit 20, the carriage unit 30, and the head unit 40) via the unit control circuit 64 according to the program which is stored in the memory 63.

Furthermore, a driving signal generating portion 65 is provided in the controller 60. The driving signal generating portion 65 is provided with a first driving signal generating portion 65A and a second driving signal generating portion 65B. The first driving signal generating portion 65A generates a first driving signal for driving a piezo element of the first nozzle group 41A. The second driving signal generating portion 65B generates a second driving signal for driving a piezo element of the second nozzle group 41B. Each driving signal generating portion generates a driving signal for odd-numbered dots in a case where dots are formed in odd-numbered dots (which will be described later), and generates a driving signal for even-numbered dots in a case where dots are formed in even-numbered dots (which will be described later). Each driving signal generating portion is independent from each other, and for example, when the first driving signal generating portion 65A generates the driving signal for odd-numbered dots, the second driving signal generating portion 65B is able to generate the driving signal for odd-numbered dots and is also able to generate the driving signal for even-numbered dots.

The controller 60 prints an image which is configured from a plurality of dots on which ink droplets are formed on a paper sheet 10 by combining the "sub-scanning operation" which moves the paper sheet 10 in the sub-scanning direction, the "main scanning operation" which reciprocally moves the head 41 in the main scanning direction, and a "pass operation" which discharges ink as liquid droplets on the paper sheet 10 from the head 41 while performing the main scanning operation. Note that, the pass operation is simply referred to as a "pass", and an $n^{th}$ pass is referred to as "pass n".

Head Configuration

Figure 3:
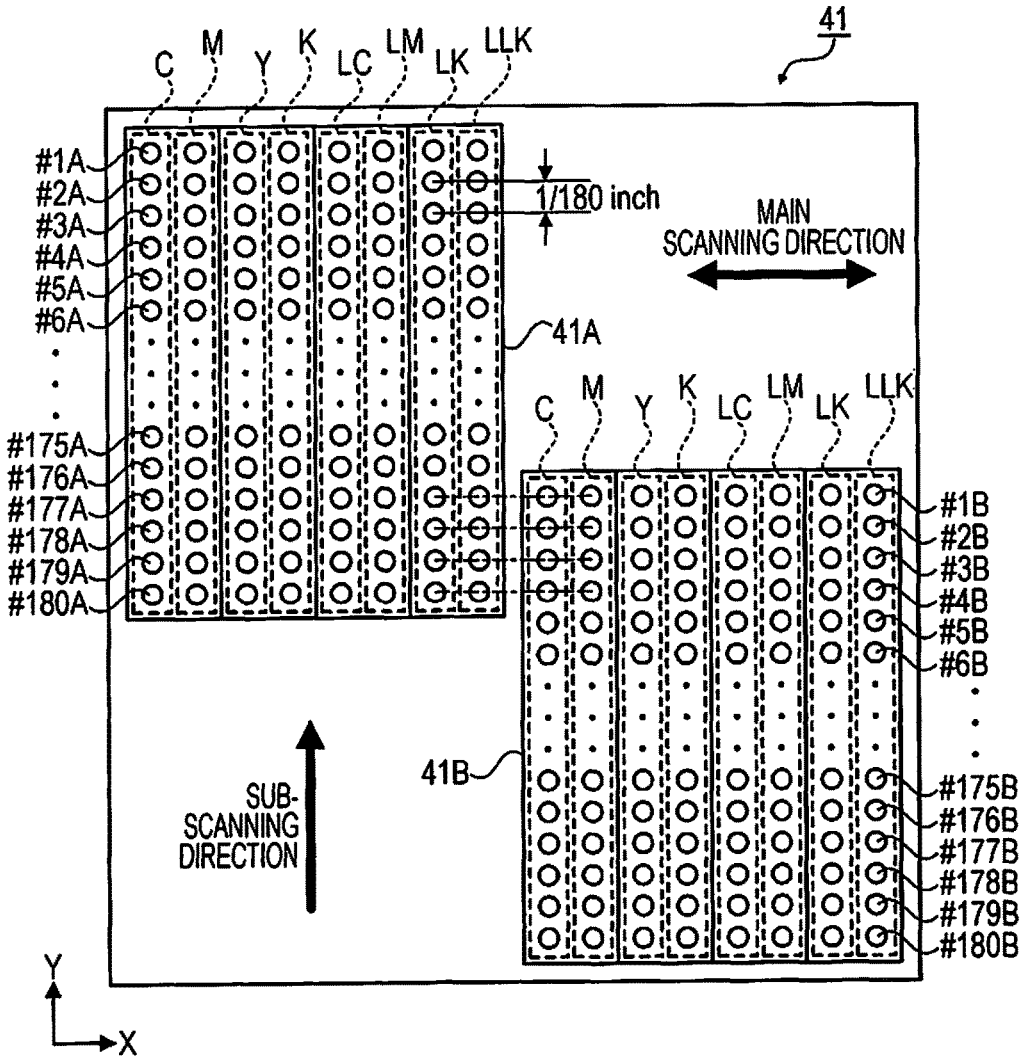
FIG. 3 is an explanatory diagram illustrating an example of a nozzle arrangement.

FIG. 3 is an explanatory diagram illustrating an example of a nozzle arrangement of the head 41. The head 41 is provided with a first nozzle group 41A and a second nozzle group 41B as two heads (nozzle groups). For example, eight nozzle rows are provided in each nozzle group, and a discharge opening of the nozzles is open to a lower surface of the head 41. Eight nozzle rows respectively discharge ink of cyan (C), magenta (M), yellow (Y), black (K), light cyan (LC), light magenta (LM), light black (LK), and very light black (LLK).

For example, 180 nozzles (nozzle #1A to #180A, nozzle #1B to #180B) which are lined up in the sub-scanning direction (predetermined direction which intersects with the main scanning direction) are provided at a nozzle pitch of 180 dpi in each nozzle row. In FIG. 3, numbers are given with lower number nozzles on the sub-scanning direction downstream side (+Y side). A piezo element (omitted from the drawings) is provided in each nozzle as a driving element for discharging ink droplets from each nozzle.

The first nozzle group 41A is provided more on the downstream side in the sub-scanning direction than the second nozzle group 41B. In addition, the first nozzle group 41A and the second nozzle group 41B are provided such that the positions of four nozzles in the sub-scanning direction overlap. For example, the position of nozzle #177A of the first nozzle group 41A in the sub-scanning direction is the same as the position of the nozzle #1B of the second nozzle group 41B in the sub-scanning direction. Thereby, in the discharge operation, when it is possible for nozzle #177A of the first nozzle group 41A to form a dot with respect to a pixel, it is also possible for nozzle #1B of the second nozzle group 41B to form a dot with respect to the pixel.

In addition, a combination of nozzle rows which discharge the same ink (ink which is configured with the same composition) between the first nozzle row 41A and the second nozzle row 41B is referred to here as a "head set".

Figure 4:
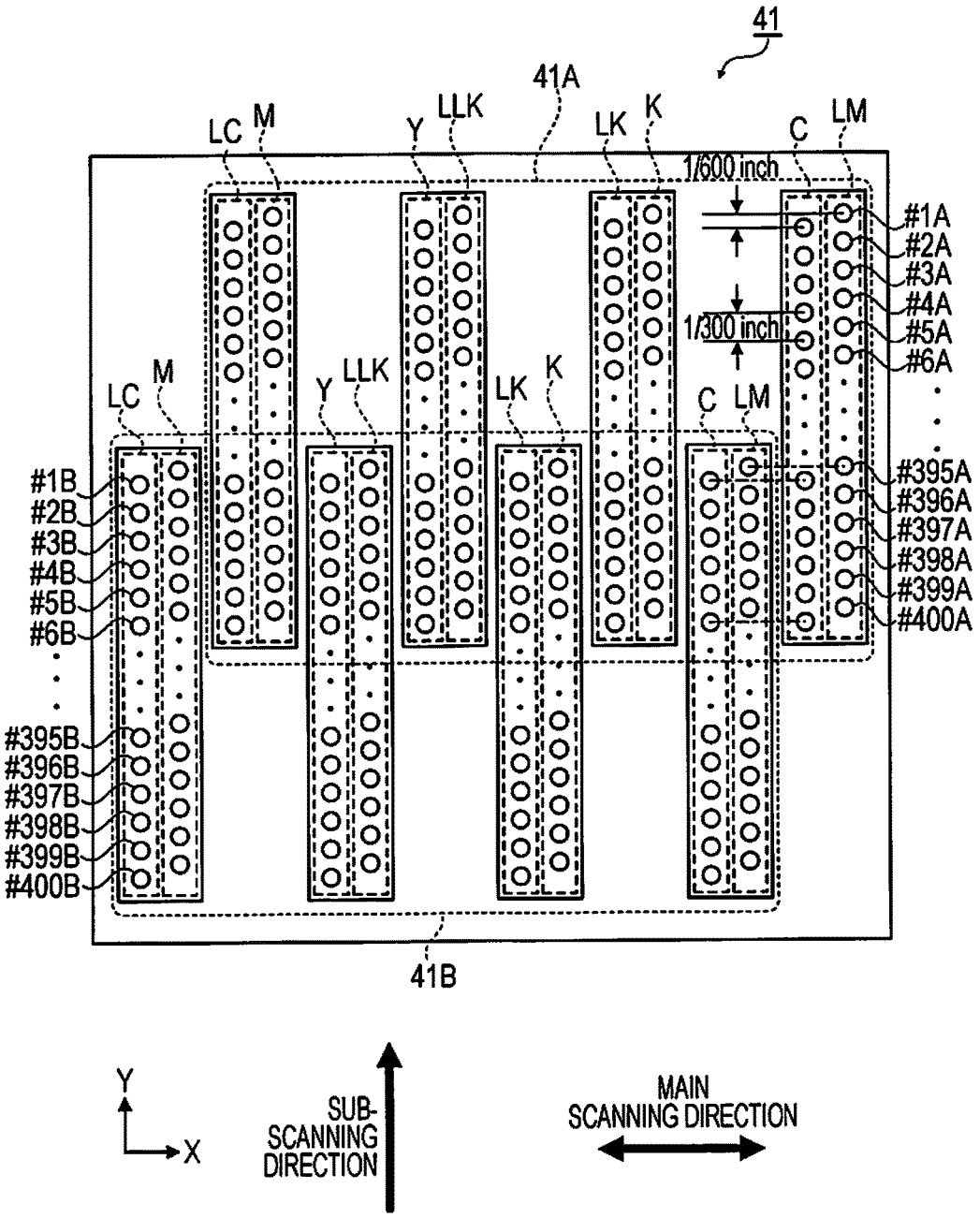
FIG. 4 is an explanatory diagram illustrating another example of a nozzle arrangement.

FIG. 4 is an explanatory diagram illustrating another example of a nozzle arrangement which the head 41 has. In the example illustrated in FIG. 4, the head set illustrated in FIG. 3 is disposed at a closer position. When describing in detail, in the example in FIG. 4, the first nozzle group 41A and the second nozzle group 41B are disposed so as to line up alternately for each set of two nozzle rows. In addition, 400 nozzles (nozzle #1A to #400A, nozzle #1B to #400B) which are lined up in the sub-scanning direction are provided on each nozzle row at a nozzle pitch of 300 dpi, and sets of two nozzle rows are disposed deviated at a half pitch (1/600 inch).

In addition, the first nozzle group 41A and the second nozzle group 41B are provided such that the positions of six nozzles in the sub-scanning direction overlap. For example, the position of a nozzle #395A of the first nozzle group 41A in the sub-scanning direction is the same as the position of the nozzle #1B of the second nozzle group 41B in the sub-scanning direction. Thereby, in the discharge operation, when it is possible for nozzle the #395A of the first nozzle group 41A to form a dot with respect to a pixel, it is also possible for the nozzle #1B of the second nozzle group 41B to form a dot with respect to the pixel.

Nozzle Rows and Nozzle Representation Method

The nozzle rows and a representation method of the nozzles will be described prior to description of the dot formation method.

Figure 5:
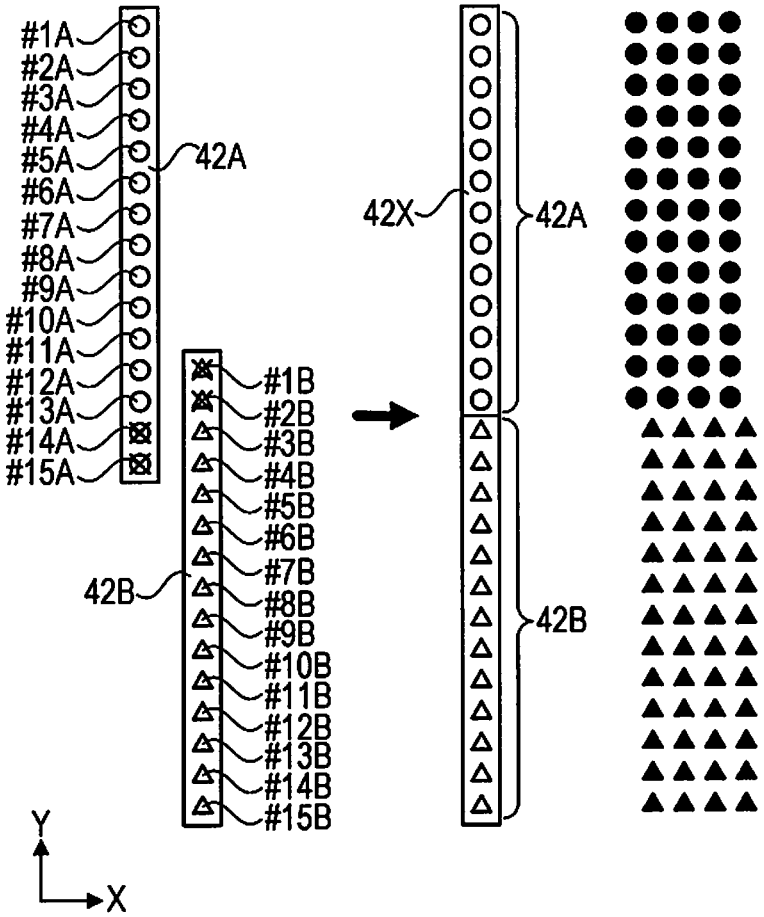
FIG. 5 is an explanatory diagram representing a head set as a virtual head set.

FIG. 5 is an explanatory diagram representing a head set as a virtual head set 42X.

For example, the black nozzle row of the first nozzle row 41A and the same black nozzle row of the second nozzle row 41B are described on the left side in FIG. 5. Hereinafter in the description, the black nozzle row of the first nozzle row 41A is referred to as a first head 42A, and the black nozzle row of the second nozzle row 41B is referred to as a second head 42B. Note that, in order to simplify the description, the number of nozzles in each nozzle row is 15. Note that, the first head 42A and the second head 42B in such a configuration are equivalent to the "nozzle row" in the application.

The positions in the sub-scanning direction of the four nozzles (nozzle #12A to nozzle #15A) on the upstream side of the first head 42A in the sub-scanning direction in each nozzle row, and the four nozzles (nozzle #1B to nozzle #4B) on the downstream side of the second head 42B in the sub-scanning direction of each nozzle row overlap. Hereinafter in the description, four nozzles being on each nozzle row is referred to as overlapped nozzles.

Each nozzle of the first head 42A is indicated with a circle, and each nozzle of the second head 42B is indicated with a triangle. In addition, a cross is given for nozzles which do not discharge ink (that is, nozzles which do not form a dot).

Here, out of the overlapping nozzles of the first head 42A, the nozzle #12A and the nozzle #13A discharge ink, and the nozzle #14A and the nozzle #15A do not discharge ink. In addition, out of the overlapping nozzles of the second head 42B, the nozzle #1B and the nozzle #2B do not discharge ink, and the nozzle #3B and the nozzle #4B discharge ink.

In this case, as described in the center portion in FIG. 5, two heads (the first head 42A and the second head 42B) which configure the head set are able to be represented as one virtual head set 42X. Hereinafter in the description, the state of dot formation is described using the one virtual head set 42X in place of the two heads which are separately drawn.

Note that, as shown on the right side in FIG. 5, in the virtual head set 42X, even when the circle nozzles form dots in odd-numbered dots (described later), it is possible for the triangle nozzles to form dots in the even-numbered dots (described later). Of course, when the circle nozzles form dots in the odd-numbered dots, it is also possible for the triangle nozzles to form dots in the odd-numbered dots.

Note that, an operation which forms a dot by discharging ink droplets from individual nozzles is performed based on printing data which is received by the controller 60, but here, for ease of explanation, presence or absence of discharge based on individual sets of printing data is omitted from the explanation. That is, a state in which dots are formed at all dot positions that are obtained by forming dots by corresponding nozzles discharging ink droplets based on printing data is explained as a base.

Normal Process Dot Formation Method

Figure 6:
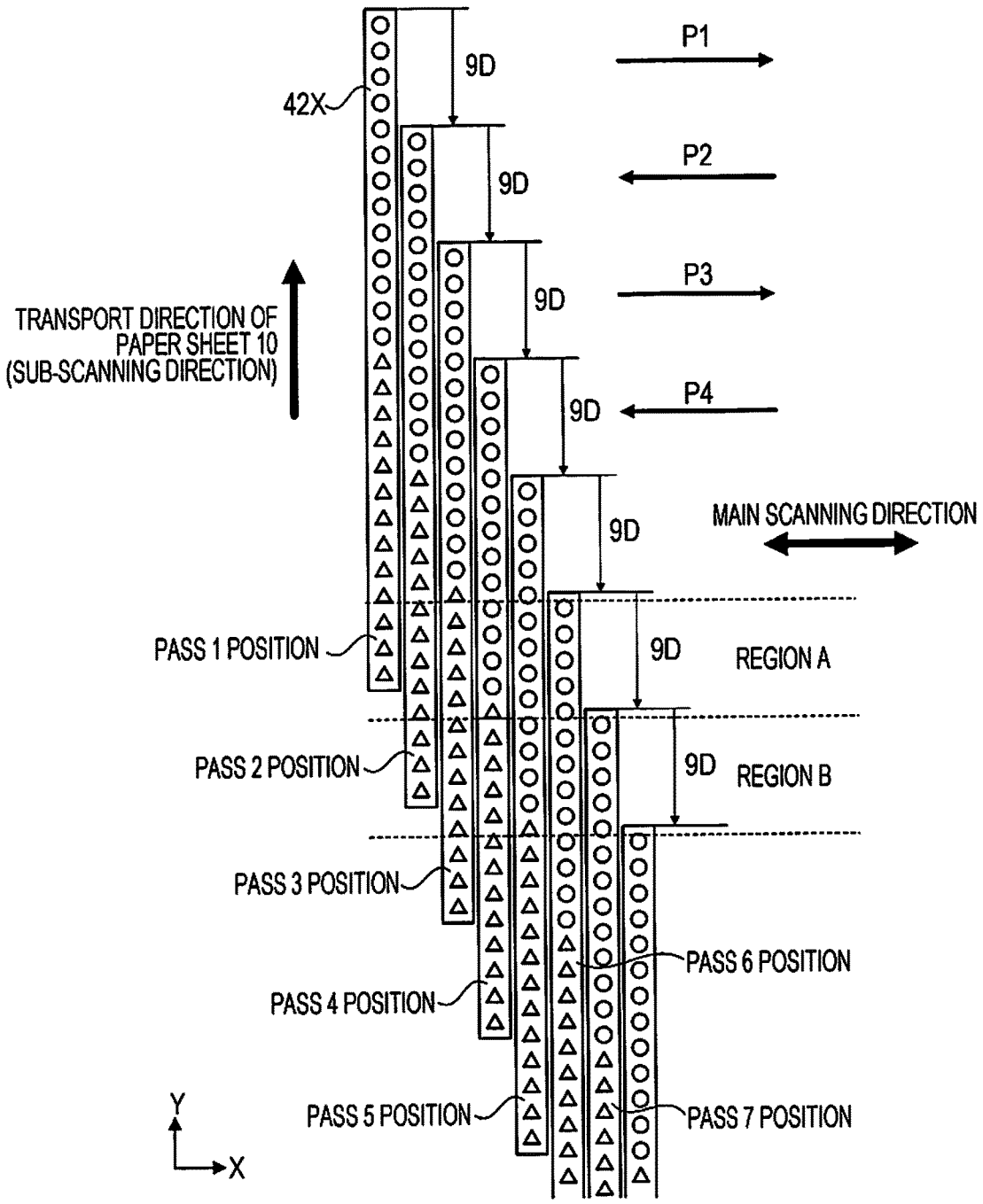
FIG. 6 is an explanatory diagram of an example of a normal process.

FIG. 6 is an explanatory diagram of an example of a normal process. The normal process is a process (pass operation and sub-scanning operation) which is performed when the center portion of the paper sheet 10 ("predetermined region" which excludes an end portion region of the paper sheet 10 that is neither the upper end portion nor the lower end portion of the paper sheet 10) is printed. The controller 60 performs the normal process which is described below by controlling each unit.

In FIG. 6, relative movement due to step movement of each amount of transport 9D of the paper sheet 10 using the transport unit 20 is indicated in an oblique direction so as not to overlap with the virtual head set 42X. That is, in FIG. 6, although the virtual head set 42X is drawn so as to move with respect to the paper sheet 10, in practice, one paper sheet 10 moves in the sub-scanning direction. In addition, in FIG. 6, the positional relationship of the virtual head set 42X in the +X direction does not have significance. In addition, arrows P1 to P4 illustrate a direction in which the virtual head set 42X is scanned in the main scanning direction (X axis direction).

In the normal process, the paper sheet 10 is transported at an amount of transport 9D of nine dots in the sub-scanning operation which is performed between passes. For example, dots are formed by pass 1 to pass 6 in region A in FIG. 6 (region above the paper sheet 10), and dots are formed by pass 2 to pass 7 in region B.

In an odd-numbered pass, for example, each nozzle is positioned on an odd-numbered raster line (dot row along the main scanning direction). After the odd-numbered pass, since an even-numbered pass is performed after the paper sheet 10 is transported at the amount of transport 9D of nine dots, in the even-numbered pass, each nozzle is positioned on the even-numbered raster line. In this manner, the position of each nozzle is a position of the odd-numbered or even-numbered raster line alternately by pass.

Figure 7:
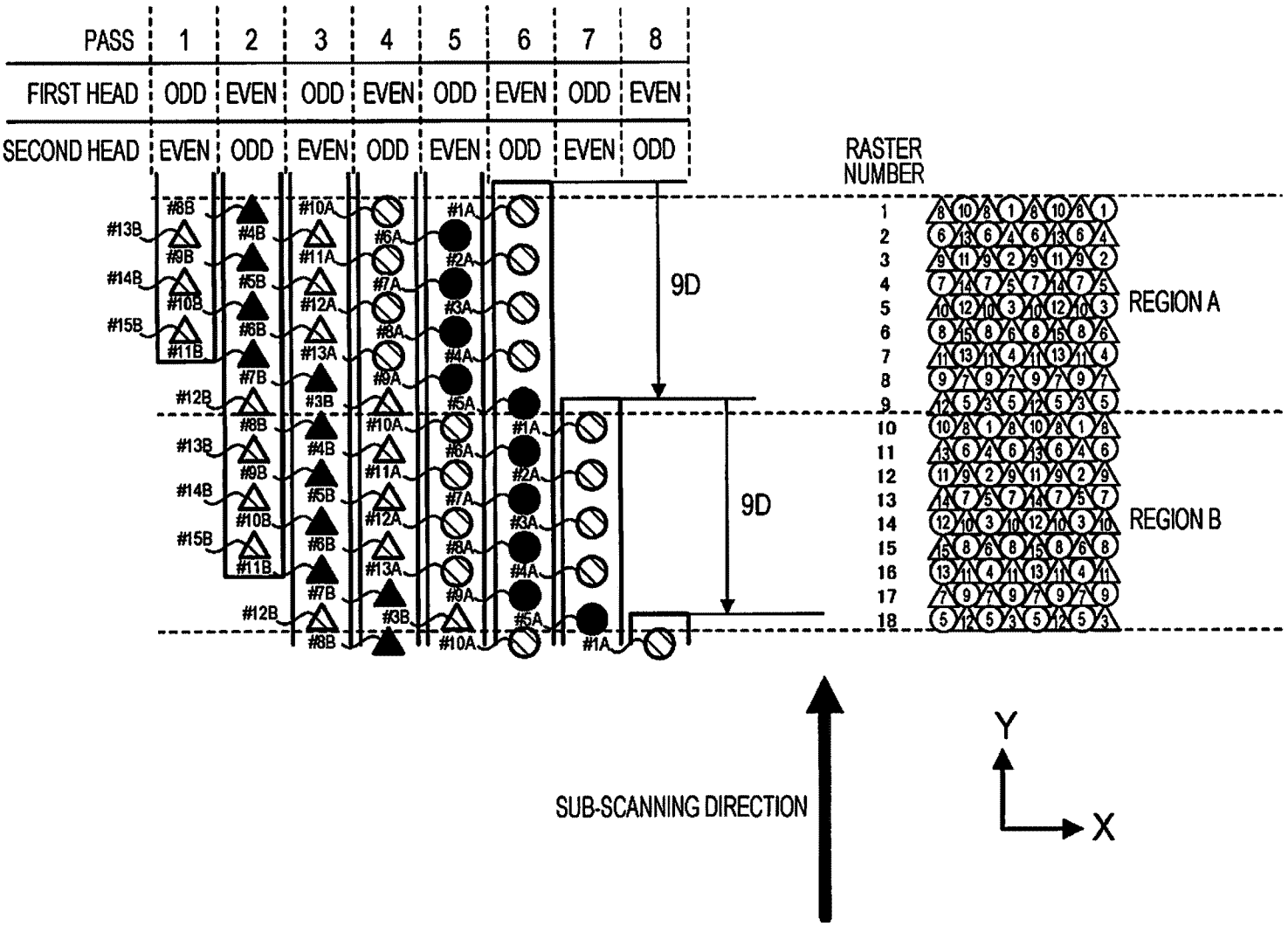
FIG. 7 is an explanatory diagram of an example of dot formation in the normal process.

FIG. 7 is an explanatory diagram of an example of dot formation in the region A and the region B in FIG. 6.

The relative position of the nozzles in each pass is illustrated on the left side in FIG. 7. In the pass, a nozzle filled in with black forms a dot at a proportion of one pixel to two pixels. For example, the nozzle #8B of pass 2 forms a dot at a proportion of one pixel to two pixels. The nozzles which are hatched with diagonal lines form a dot at a proportion of one pixel to four pixels. For example, the nozzle #10A of pass 4 forms a dot at a proportion of one pixel to four pixels.

The nozzles which are hatched with diagonal lines do not form a half dot in comparison to the nozzle filled in with black. Hereinafter, the nozzles which are hatched with diagonal lines will be referred to as partial overlap nozzles. Four nozzles (nozzle #10A to nozzle #13A) on the upstream side (−Y side) of the first head 42A of a pass in the sub-scanning direction, and four nozzles (nozzle #1A to nozzle #4A) on the downstream side (+Y side) of the first head 42A in the sub-scanning direction after the sub-scanning operation is performed two times from the pass overlap at positions in the sub-scanning direction. Such nozzles are partial overlap nozzles. For example, since the nozzle #10A to the nozzle #13A of pass 4 and the nozzle #1A to the nozzle #4A of pass 6 overlap at positions in the sub-scanning direction, the nozzles are partial overlap nozzles.

Four nozzles (nozzle #12B to nozzle #15B) on the upstream side of the second head 42B of a pass in the sub-scanning direction, and four nozzles (nozzle #3B to nozzle #6B) on the downstream side of the second head 42B in the sub-scanning direction after the sub-scanning operation is performed two times from the pass overlap at positions in the sub-scanning direction. Such nozzles are partial overlap nozzles. For example, since the nozzle #12B to the nozzle #15B of pass 2 and the nozzle #3B to the nozzle #6B of pass 4 overlap at positions in the sub-scanning direction, the nozzles are partial overlap nozzles. In addition, as a result of printing using partial overlap nozzles, control to print such that a partial region overlaps in another pass with respect to a region that is printed in one pass refers to partial overlap control.

The nozzles which form dots in the respective pixels are illustrated on the right side in FIG. 7. For example, a first raster line (raster number of one line) is configured by dots which are formed in odd-numbered dots by the nozzle #8B and dots which are formed in even-numbered dots by the nozzle #10A and the nozzle #1A. Here, in order to simplify the description, each raster line is configured by only eight dots.

The positions of the dots which are formed by each head are illustrated in the top left in FIG. 7. For example, in pass 1, nozzles (nozzle #1A to nozzle #13A) of the first head 42A form dots in odd-numbered dots, and nozzles (nozzle #3B to nozzle #15B) of the second head 42B form dots in even-numbered dots.

Each raster line is configured from dots which are formed using two or three nozzles. In other words, two or three nozzles are associated with each raster line. For example, the nozzle #8B of pass 2, the nozzle #10A of pass 4, and the nozzle #1A of pass 6 are associated with the first raster line. In addition, each raster line is configured from dots which are formed using at least one nozzle of the first head 42A, and dots which are formed using at least one nozzle of the second head 42B. In other words, at least one nozzle of the first head 42A and at least one nozzle of the second head 42B are associated with each raster line.

In a case where only one nozzle is associated with the odd-numbered dot or the even-numbered dot of the raster line, the nozzle forms a dot at a proportion of one dot to two dots. For example, the nozzle #8B is associated with only one (another nozzle is not associated) odd-numbered dot of the first raster line. For this reason, the nozzle #8B forms a dot at a proportion of one dot to two dots.

Meanwhile, in a case where two nozzles are associated with the odd-numbered dot or the even-numbered dot of the raster line, the two nozzles each form a dot at a proportion of one dot to four dots (become partial overlap nozzles). For example, the nozzle #10A and the nozzle #1A are associated with the even-numbered dots of the first raster line. For this reason, the nozzle #10A and the nozzle #1A each form a dot at a proportion of one dot to four dots (become partial overlap nozzles).

In the normal process, in the pass, a position at which the first head 42A forms dots (position in the scanning direction) is different from a position at which the second head 42B forms dots. In detail, when the first head 42A forms dots in the odd-numbered dots, the second head 42B forms dots in the even-numbered dots. Alternatively, when the first head 42A forms dots in the even-numbered dots, the second head 42B forms dots in the odd-numbered dots. Since the first driving signal generating portion 65A and the second driving signal generating portion 65B described above are able to generate driving signals independently from each other, such dot formation is possible.

In addition, in the normal process, when comparing the pass and a subsequent pass, the positions at which each head forms dots are different. For example, in a case where the first head 42A forms the dots in the odd-numbered dots and the second head 42B forms the dots in the even-numbered dots in the pass, in the subsequent pass, the first head 42A forms the dots in the even-numbered dots and the second head 42B forms the dots in the odd-numbered dots.

By forming the dots in this manner, the dots are formed in a zig-zag shape by the one head, and the dots are formed in a zig-zag shape by the other head so as to fill between the zig-zag shape of the one head. When taking note of the right side in FIG. 7, the circle dots which are formed by the first head 42A are in the zig-zag shape, and the triangle dots which are formed by the second head 42B are also in the zig-zag shape. Here, from the dot forming order, after the dots which are formed by the second head 42B in the zig-zag shape, the dots which are formed by the first head 42A are formed so as to fill between.

In a case where the raster line is formed in the normal process, in the raster line, half dots are formed by the first head 42A and the remaining half dots are formed by the second head 42B. In other words, a usage rate of each head when the raster line is formed is 50% (fixed) for the first head 42A, and also 50% (fixed) for the second head 42B.

Since the dots are formed in region A by pass 1 to pass 6 and the dots are formed in region B by pass 2 to pass 7, the passes are shifted by one between region A and region B. Although the nozzles which are associated with each raster line are common to each region in order to shift the passes by one, the positions of the dots (main scanning direction positions) which are formed by each nozzle are different for the odd-numbered dots and the even-numbered dots. For example, the nozzle #8B of pass 2 forms the dots on the odd-numbered dots with respect to the first raster line, but the nozzle #8B of pass 3 forms the dots on the even-numbered dots with respect to the tenth raster line.

Note that, although not illustrated here, the $19^{th}$ to $27^{th}$ raster lines which are positioned more on the upstream side than region B in the sub-scanning direction form dots in substantially the same manner as in region A using pass 3 to pass 8. For example, the $19^{th}$ raster line is associated with the nozzle #8B, the nozzle #10A, and the nozzle #1A, and nozzle #8B forms dots on the odd-numbered dots of the $19^{th}$ raster line. In addition, the $28^{th}$ to $36^{th}$ raster lines which are positioned more on the upstream side than the $19^{th}$ to $27^{th}$ raster lines in the sub-scanning direction form dots in substantially the same manner as in region B using pass 4 to pass 9. In this manner, when continuously performing the normal process, dot formation is repeatedly performed in the same manner in region A and region B.

For example, in a case where high-definition images are formed on the paper sheet 10 by forming dots on the paper sheet 10, the paper sheet 10 is reliably held at a position (and height) during the discharge operation, in addition, in the sub-scanning operation, it is necessary to accurately move the paper sheet 10 to the predetermined position. For this reason, for example, the transport unit 20 fixes (holds) the paper sheet 10 by means such as interposing, pressing, and suctioning. It is necessary for the fixing (holding) means to be configured such that movement of the carriage unit 30, the head unit 40, and the like do not interfere. In other words, in the upper end portion or lower end portion of the paper sheet 10, printing is started in a state (position) of being reliably fixed (held), or in a complete configuration. As a result, for example, in the manner of the embodiment, in the configuration in which the first nozzle group 41A and the second nozzle group 41B that have nozzle rows lined up in the sub-scanning direction (+Y direction) are lined up in the sub-scanning direction (+Y direction), there are cases where dots are forced to be formed only in a nozzle which is able to correspond to heads (first head 42A or second head 42B) which are able to correspond respectively to the upper end portion and the lower end portion of the paper sheet 10.

Upper End Process Dot Formation Method

An example of an upper end process of a case in which it is not possible to form the image that is partial overlap controlled between a plurality of heads will be described below. The upper end process is a process (discharge operation and sub-scanning operation) which is performed when the upper end region of the paper sheet 10 (end portion region on the +Y side) is printed. The controller 60 performs the upper end process which is described below by controlling each unit.

Figure 8:
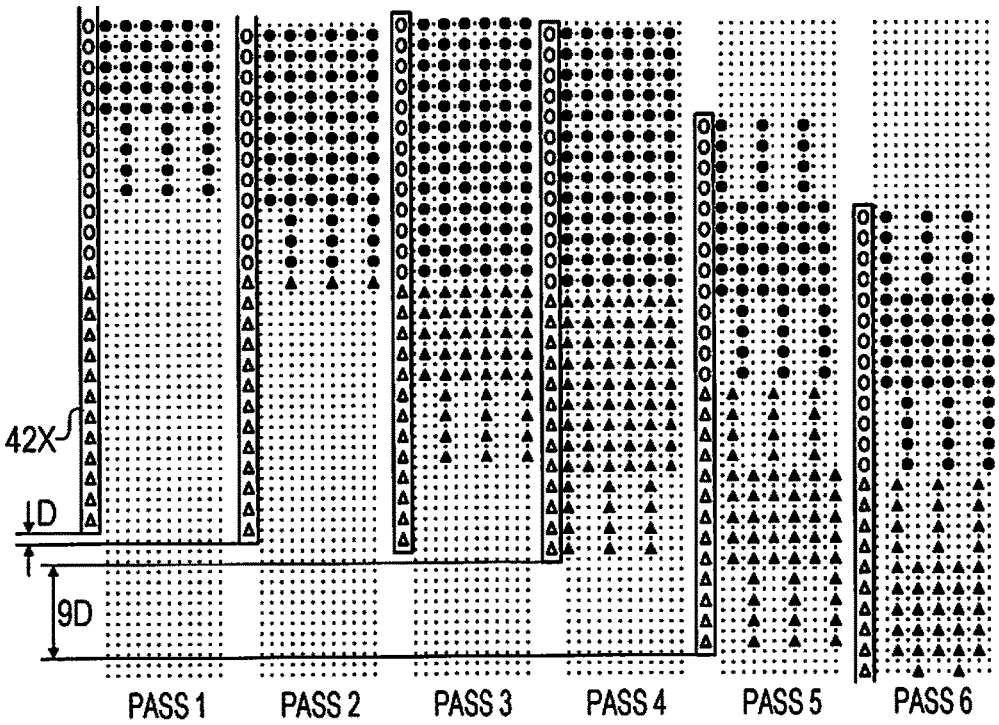
FIG. 8 is an explanatory diagram illustrating positions of discharged ink droplets in an example of an upper end process.
Figure 9:
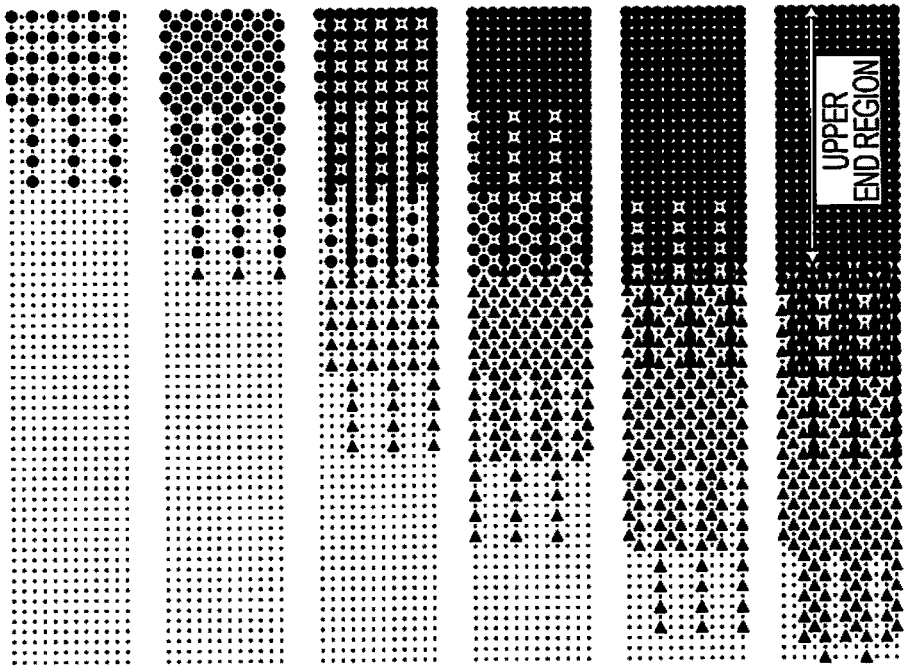
FIG. 9 is an explanatory diagram illustrating discharged dot rows in an example of the upper end process.

FIGS. 8 and 9 are explanatory diagrams of an example of the upper end process.

Pass 1 to pass 4 illustrated in FIG. 8 illustrate the positions of the virtual head set 42X and the discharged ink droplets in the upper end process, and pass 5 and pass 6 illustrate positions of the virtual head set 42X and the discharged ink droplets in the normal process that is subsequent to the upper end process.

FIG. 9 illustrates dots which are formed on the paper sheet 10 in pass 1 to pass 6. That is, the result of superimposing positions of the ink droplets in pass 1 to pass 4 in FIG. 8 is indicated in FIG. 9.

In the example illustrated here, the upper end process is performed in pass 1 to pass 4, and the normal process is performed in pass 5 and thereafter. In the upper end process, the paper sheet 10 is transported at the amount of transport D of sets of one dot (amount of transport that is shorter than the amount of transport 9D in the normal process) in the sub-scanning operation which is performed between passes.

In the upper end process, in the odd-numbered pass, each nozzle is positioned on an odd-numbered raster line. After the odd-numbered pass, since the paper sheet 10 is transported at the amount of transport of one dot set, in the even-numbered pass, each nozzle is positioned on the even-numbered raster line. In this manner, also in the upper end process, the position of each nozzle is a position of the odd-numbered or even-numbered raster line alternately by pass.

In the normal process described above, since the dots are formed in respective zig-zag shapes by each head, a dot formation position of the first head 42A in a pass and a dot formation position of the second head 42B are caused to be different. For example, when the first head 42A forms dots in the odd-numbered dots, the second head 42B forms dots in the even-numbered dots.

In contrast to this, in the upper end process, the dot formation position of the first head 42A in a pass and a dot formation position of the second head 42B are the same. For example, in pass 1, the first head 42A and the second head 42B form dots in both odd-numbered dots.

In addition, in the normal process described above, since the dots are formed in respective zig-zag shapes by each head, dot formation positions of each head between a pass and a subsequent pass are caused to be different. For example, in a case where the first head 42A forms the dots in the odd-numbered dots and the second head 42B forms the dots in the even-numbered dots in the pass, in the subsequent pass, the first head 42A forms the dots in the even-numbered dots and the second head 42B forms the dots in the odd-numbered dots.

In contrast to this, the dot formation positions of each head are modified in order of odd-numbered dot (pass 1)→even-numbered dot (pass 2)→even-numbered dot (pass 3)→odd-numbered dot (pass 4). That is, in the upper end process, the dot formation positions of each head between the pass and the subsequent pass are not necessarily different. For example, in pass 2 and pass 3, the dot formation positions are the same even-numbered dots.

The reason that the normal process is different from the upper end process is that in contrast to the normal process in which dots are formed in respective zig-zag shapes by each head, in the upper end process, out of four passes, dots are formed in zig-zag shapes in two front half passes and dots are formed in zig-zag shapes in two rear half passes so as to be embedded between dots in zig-zag shapes.

Due to the dot formation method, the $1^{st}$ up to the $25^{th}$ raster line (upper end side raster line of the paper sheet 10) are formed only by the first head 42A. In other words, a usage rate of the head when the $1^{st}$ up to the $25^{th}$ raster lines are formed is 100% for the first head 42A, and 0% for the second head 42B.

Figure 10:
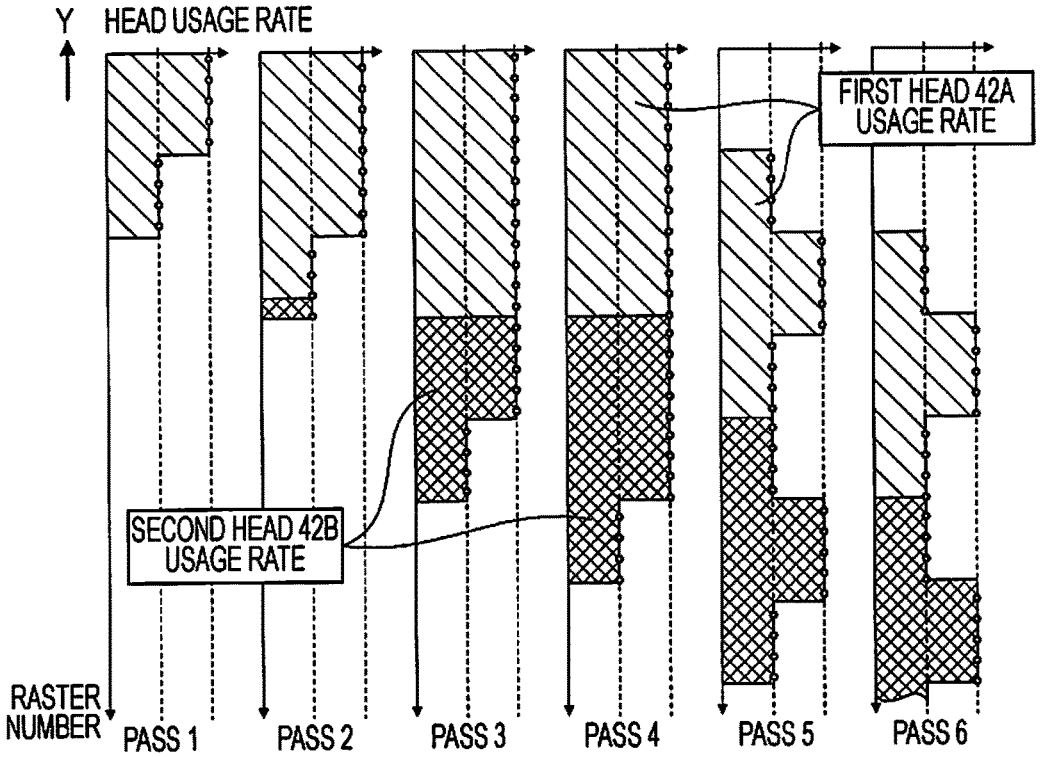
FIG. 10 is a graph schematically illustrating a head usage rate.

FIG. 10 is a graph schematically illustrating usage rate of the first head 42A and the second head 42B in each pass (pass 1 to pass 6) illustrated in FIG. 8.

Up to this point, for ease of understanding, an illustration is described in a range in which it is possible to visually recognize dots. For this reason, as shown in FIG. 10, change of usage rate (difference of a raster number direction) of each head is indicated in a stepwise manner, but in actual usage, since an image is formed by countless dots which are formed by ink droplets of number picoliters using the head which has hundreds of nozzles, the usage rate of each head is able to be illustrated approximating the change to a straight line or curve as indicated in the following illustrations.

Figure 11:
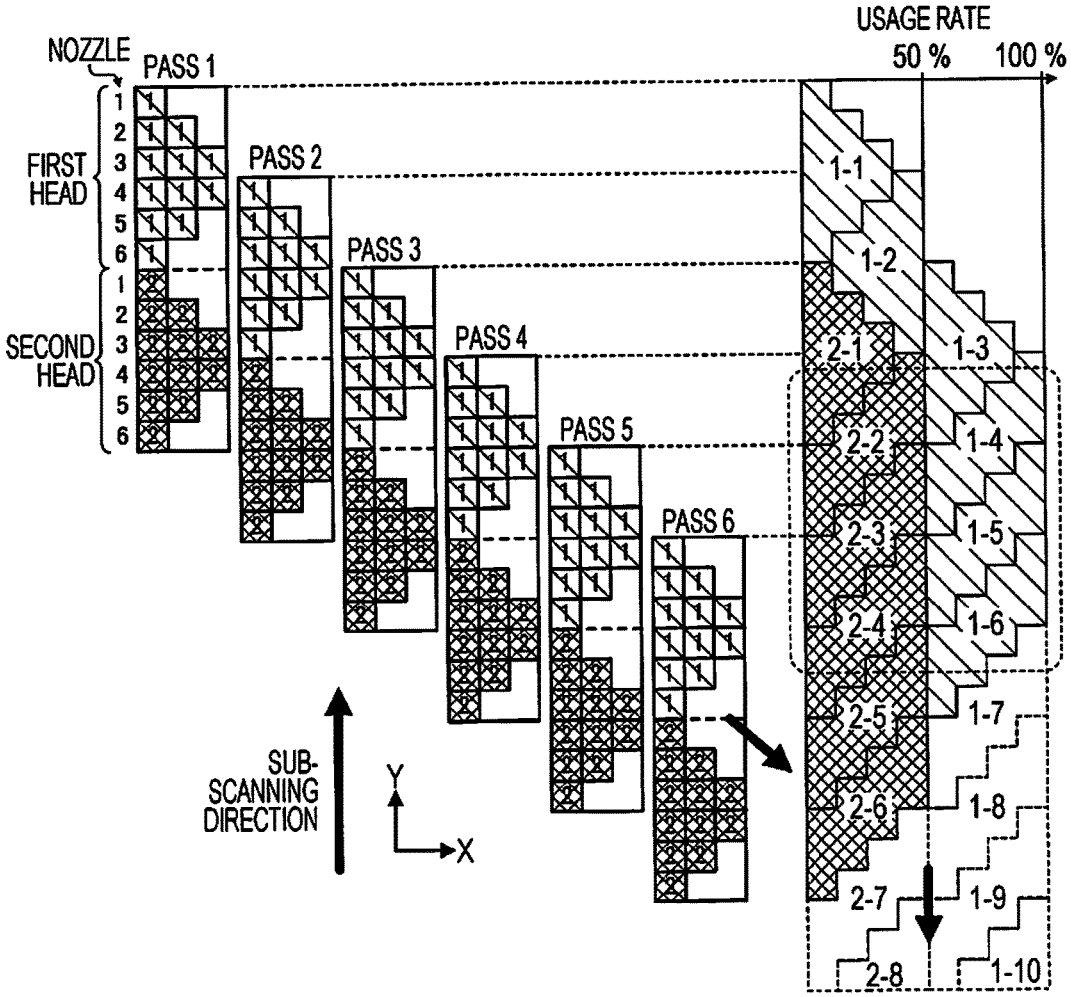
FIG. 11 is a configuration diagram of a pass in the normal process in which a head usage rate is represented using a collinear approximation.
Figure 12:
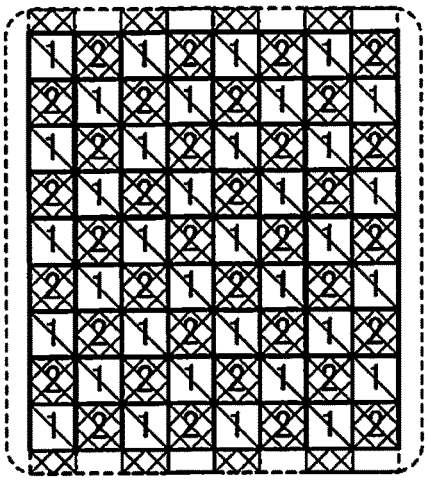
FIG. 12 is an explanatory diagram of a solid pattern in a case where the head usage rate is 50%.
Figure 13:
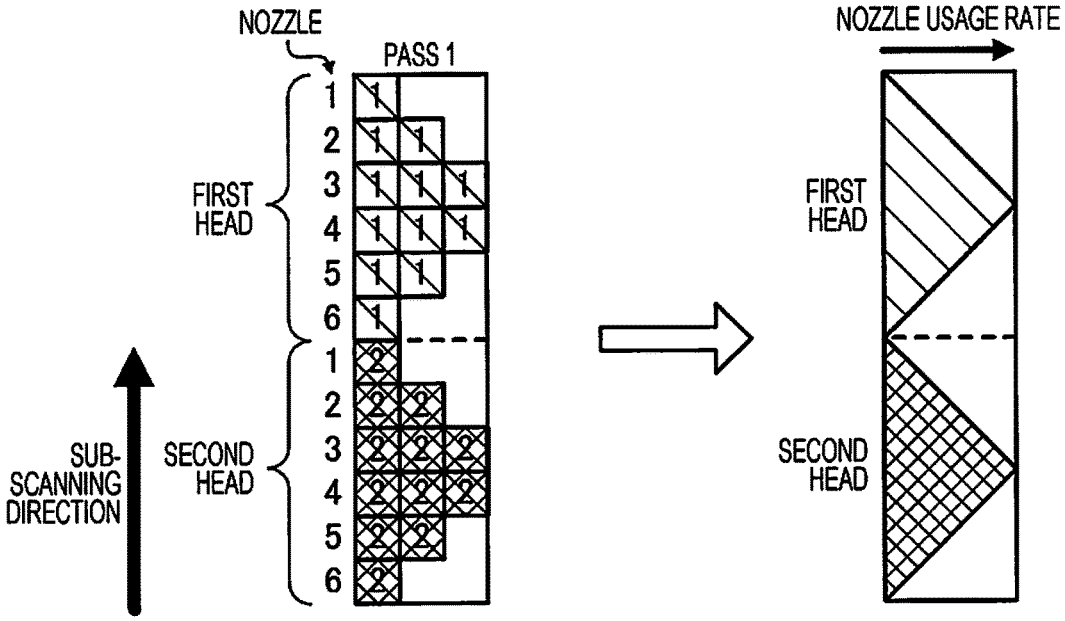
FIG. 13 is an explanatory diagram of a case representing a graphic of the head usage rate using a collinear approximation.

FIGS. 11 to 13 are explanatory diagrams of a case representing a graphic of the head usage rate using a collinear approximation.

For example, FIG. 11 illustrates the normal process which forms a maximum three dots per nozzle in one pass using two heads which have six nozzles. As shown on the right side in FIG. 11, in the normal process, four dots which are formed by respective heads, that is, usage rate of each head form solid patterns of 50% (dot arrangement is arranged in a zig-zag shape as shown in FIG. 12).

In a case where an image is formed by countless dots which are formed by ink droplets of number picoliters using a head which has hundreds of nozzles, the dot number is replaced with the usage rate of each nozzle (hereinafter referred to as nozzle usage rate), and a block which is stacked in a pyramid shape that is drawn in each pass in FIG. 11 is able to be expressed by triangles (alternatively trapezoids) as shown in FIG. 13. Note that, in one pass operation, the nozzle usage rate illustrates a proportion of positions at which it is possible to discharge ink droplets of each nozzle with respect to dischargeable positions. That is, in the solid pattern, ink droplets are discharged at all dischargeable positions, but there are cases where discharge is not performed at a position at which ink droplets are dischargeable according to the image.

Hereinafter, description is made expressed using triangles (alternatively trapezoids), and expressing distribution of the nozzle usage rate in each pass (that is, usage rate of each head of each raster line).

Figure 14:
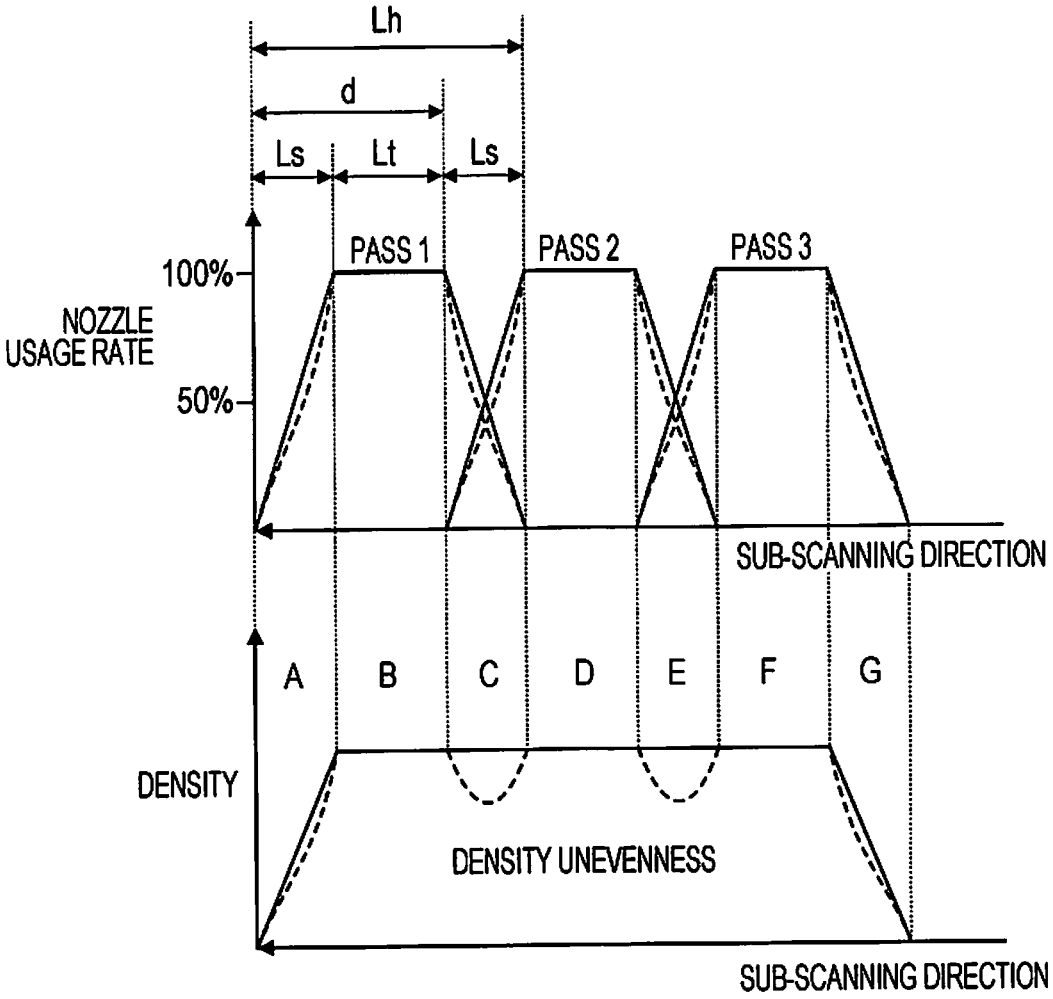
FIG. 14 is a conceptual diagram for explaining density unevenness of an image which is generated by superimposing in the pass operation.

FIG. 14 is a conceptual diagram for describing density unevenness of the image which is generated by superimposing in the pass operation.

In FIG. 14, a circumstance is indicated in which the solid pattern is formed by three pass operations. The diagram illustrating the upper side of FIG. 14 indicates the sub-scanning direction using the horizontal axis and nozzle usage rate using the vertical axis. That is, an axes relationship is described in which the axis in FIG. 13 is rotated left by 90°. In addition, in FIGS. 10 and 11, description is made such that an illustration indicating the pass operation does not overlap, but in the present illustrations, the overlapping positions are described as overlapping for ease of understanding.

The diagram illustrated on the lower side in FIG. 14 is a diagram illustrating a density distribution of the solid pattern which is formed by three pass operations.

In a nozzle row with a length of Lh between both end nozzles in the sub-scanning direction, respective pass operations are configured from a part of a length Ls at which the nozzle usage rate transitions from 0% (lowest nozzle usage rate) up to 100% (maximum nozzle usage rate), a part of a length Lt at which the nozzle usage rate is continuous at 100%, and a part of a length Ls at which the nozzle usage rate transitions from 100% up to 0%. In addition, a length d at which the recording medium (paper sheet 10) is relatively moved in one sub-scanning operation is d=Ls+Lt.

By such pass operations, as indicated by a solid line in the illustration on the lower side in FIG. 14, a region A is a region in which density increases accompanying a raise of the nozzle usage rate, and since regions from B to F have a nozzle usage rate of the respective pass operations that total 100%, regions B to F are regions that are transitioned at a fixed density, and a G region is a region in which density is lowered accompanying a reduction of the nozzle usage rate.

However, there are cases where there is not necessarily a linear relationship between the nozzle usage rate and density (tone) of the image by formed dots. For example, in a case where the nozzle usage rate is 50%, in an ideal linear relationship, it is desired that the density is 50% with respect to density of 100%, but as indicated by a broken line in the illustration on the upper side in FIG. 14, there are cases in which there is a weak density characteristic of approximately 10 to 20% in a region in which the density is to become 50%. That is, there are cases in which a characteristic of a low nozzle usage rate of approximately 10 to 20% is indicated in comparison to the nozzle usage rate in the ideal (linear) case.

There are various causes for such characteristics, but specific description is omitted. Note that, such a characteristic does not remarkably appear in one pass operation, but there are cases where the characteristic is similarly generated due to the overlapped position by overlapping a plurality of passes. For example, in a case such that there is overlapping at positions with close to 50% nozzle usage rate of respective passes in the manner of the C region and the E region in the illustration on the upper side in FIG. 14, there are cases where there is a phenomenon in which the formed solid pattern density is reduced by an interaction by the respective passes overlapping.

In a case where there is such a density characteristic, there are cases in which density unevenness is apparent to the extent that it is possible visually recognize as illustrated by a broken line in the illustration on the lower side in FIG. 14 due to superimposed positions of the pass operation. In the example of the present drawing, since the regions in which the density is reduced in each pass operation mutually overlap, such density unevenness becomes apparent.

In contrast to this, in the embodiment, generation of density unevenness is reduced by further appropriately setting specifications for superimposing pass operations in the case of such density characteristics.

That is, in the embodiment, there is provided a printer 100 as the liquid droplet discharging apparatus including the head 41 which has the nozzle that discharges ink droplets on the paper sheet 10, the carriage unit 30 which performs a main scanning operation which relatively moves the head 41 on the paper sheet 10 in the main scanning direction, and the transport unit 20 which performs the sub-scanning operation which relatively moves the paper sheet 10 in a sub-scanning direction which intersects with the main scanning direction with respect to the head 41, and forming the image consisting of a plurality of dot rows on the paper sheet 10 by repeating the pass operation which forms dot rows lined up in the main scanning direction by discharging the liquid droplets on the paper sheet 10 from the nozzle while performing the main scanning operation, and the sub-scanning operation, or a liquid droplet (ink droplet) discharge method which discharges ink droplets by using the printer 100, in which the nozzle configures the nozzle rows (first head 42A and second head 42B) lined up in a predetermined direction which intersects with the main scanning direction, when a proportion of positions for which discharge of the ink droplets is possible to positions to which each nozzle can discharge the liquid droplets in one pass operation is a nozzle usage rate, the maximum nozzle usage rate in formation of the image is a maximum nozzle usage rate, a length between nozzles at both ends in the sub-scanning direction in the nozzles which configure the nozzle row is Lh, a length by which the paper sheet 10 is relatively moved in one sub-scanning operation is d, a length in the sub-scanning direction of an arrangement of consecutive nozzles with the maximum nozzle usage rate in the nozzles which configure the nozzle row is Lt, and n is a natural number, in the pass operation with respect to a predetermined region except an end portion region of the paper sheet 10, $Lt=4\times d\times n-Lh$.

In addition, setting in this manner, when k is a natural number and an average number of pass operations which are necessary in formation of the dot rows lined up in the main scanning direction in the predetermined region (region which performs the normal process) is x, d and n are set such that $k<x<k+1$.

Detail description is made below.

Figure 15:
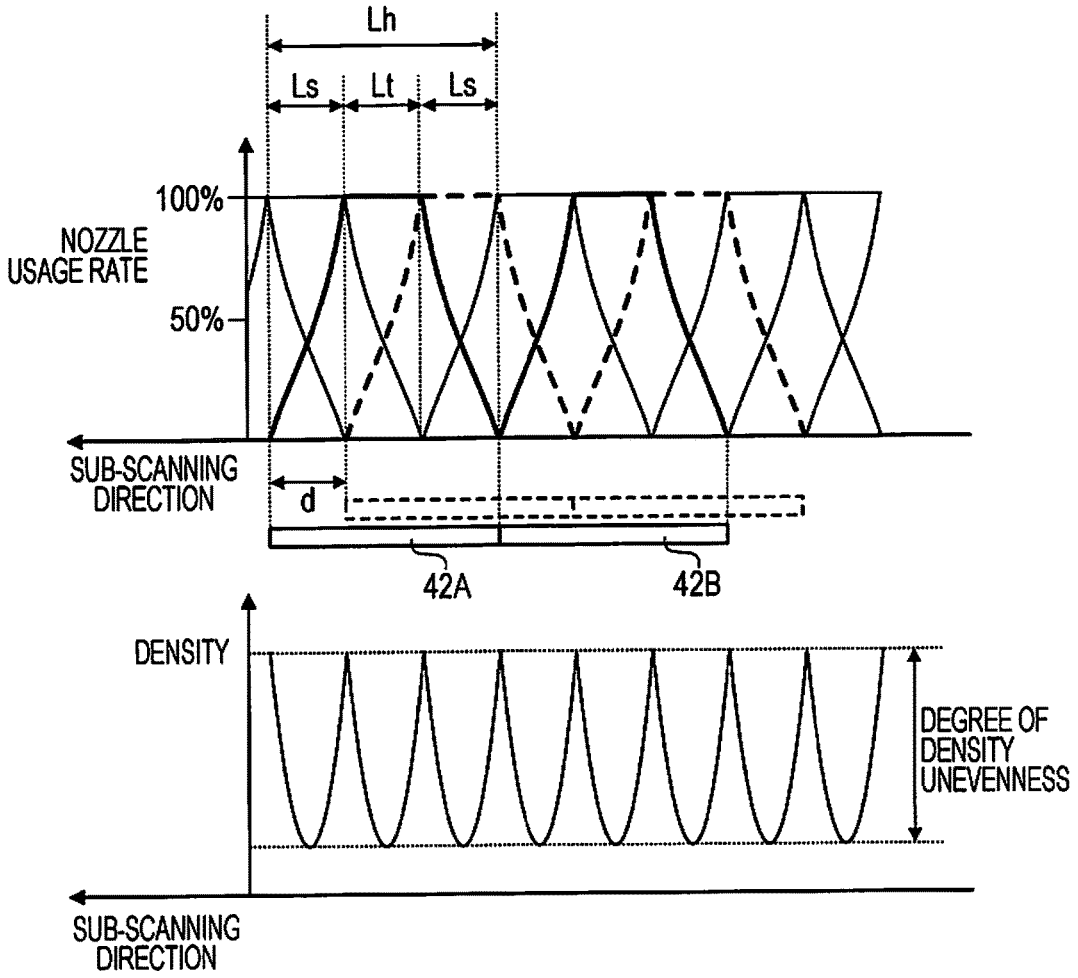
FIG. 15 is a conceptual diagram illustrating a case where density unevenness remarkably appears.

FIG. 15 is a conceptual diagram illustrating a circumstance of a case in which density unevenness remarkably appears when formation of the solid pattern is possible by repeating the pass operation in the plurality of head configurations. As shown in a thick solid line indicated on a graph on the upper side in FIG. 15, an example is indicated in a case where one pass is performed by the first head 42A and the second head 42B described above.

When describing considering the pass by the first head 42A, in a nozzle row with a length of Lh between both end nozzles in the sub-scanning direction, passes are configured from a part of a length Ls at which the nozzle usage rate transitions from 0% (lowest nozzle usage rate) up to 100% (maximum nozzle usage rate), a part of a length Lt at which the nozzle usage rate is continuous at 100%, and a part of a length Ls at which the nozzle usage rate transitions from 100% up to 0%.

In addition, the subsequent pass is a pass indicated by a thick broken line which is shown in the graph on the upper side in FIG. 15, and the length d at which the recording medium (paper sheet 10) is relatively moved in one sub-scanning operation is disposed at a position where d=Ls.

That is, d=Ls and n=1, as a result, since $Lt=4\times d\times n-Lh=4Ls-Lh$, and $2Ls+Lt=Lh$, $Ls=Lt$. In addition, since $d=Ls=Lt$, x=6.0 such that an average number x of pass operations which are necessary in formation of dot rows lined up in the main scanning direction is apparent from the illustration. Note that, this does not satisfy $k<x<k+1$.

In addition, in the example, in each pass, in the same manner as a case described above, a relationship of the nozzle usage rate in the respective pass, and tone (density) of the image by the formed dot is not linear, deviation from the ideal value becomes largest in a case where the nozzle usage rate is 50%, and the characteristic in which density is lowered to 20% (characteristic which is approximated by a quadratic function) is held.

By setting $Lt=4\times d\times n-Lh$, when the nozzle usage rate and the tone (density) of the image by the formed dots have a linear relationship, it is possible to set by forming a uniform solid pattern. However, in a case where the relationship between the nozzle usage rate in the respective passes and the tone (density) of the image by the formed dots is not linear, there are cases in which influence on the solid pattern manifests, and as shown in FIG. 15, in a case of the pass operation in which x=6.0, since density unevenness overlaps a maximum region (region in which deviation from the ideal value becomes largest) of an unevenness characteristic of respective passes, the density unevenness indicates a larger value on the graph illustrated on the lower side in FIG. 15. The graph illustrated on the lower side in FIG. 15 indicates density distribution, the size of variance (range of density difference) is the degree of the density unevenness.

In the embodiment, furthermore, since the degree of such density unevenness is reduced, the value of d is set such that $k<x<k+1$.

In detail, by further modifying the value of d holding the relationship of $Lt=4\times d\times n-Lh$ without change, the degree of density unevenness is reduced by reducing the degree of overlapping of the maximum region (region in which deviation from the ideal value becomes largest) of the unevenness characteristic of the respective passes.

Figure 16:
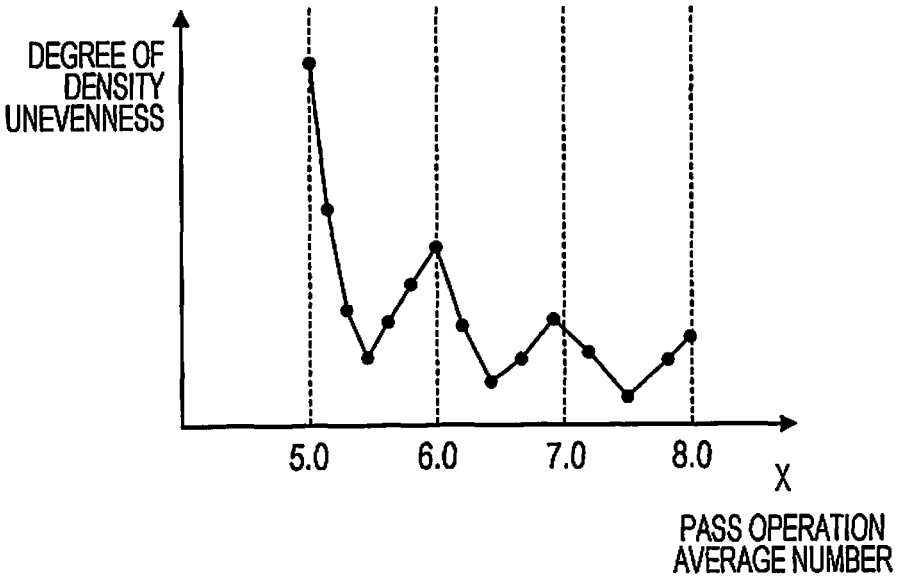
FIG. 16 is a graph illustrating a degree of density unevenness in a case where a value of d is changed.

FIG. 16 is a graph illustrating a degree of density unevenness of a case where the value of d is changed.

The horizontal axis of the graph is the average number x of the pass operations in a case where the value of d is changed and the vertical axis is the degree of density unevenness.

As understood from the graph, the average number x of pass operations is indicated by a large value of the degree of density unevenness in comparison to the previous and latter values in a state of representing by an integer of 5, 6, 7, or 8 times. Here, the average number x of pass operations has a large degree of overlapping of the regions with each other in which the density is lowered in each pass operation in a state of representing by an integer.

Accordingly, it is preferable to set d such that $k<x<k+1$. In addition, it is more preferable to set $k+0.2\leq x\leq k+0.8$, and it is further preferable to set $k+0.3\leq x\leq k+0.7$.

Figure 17:
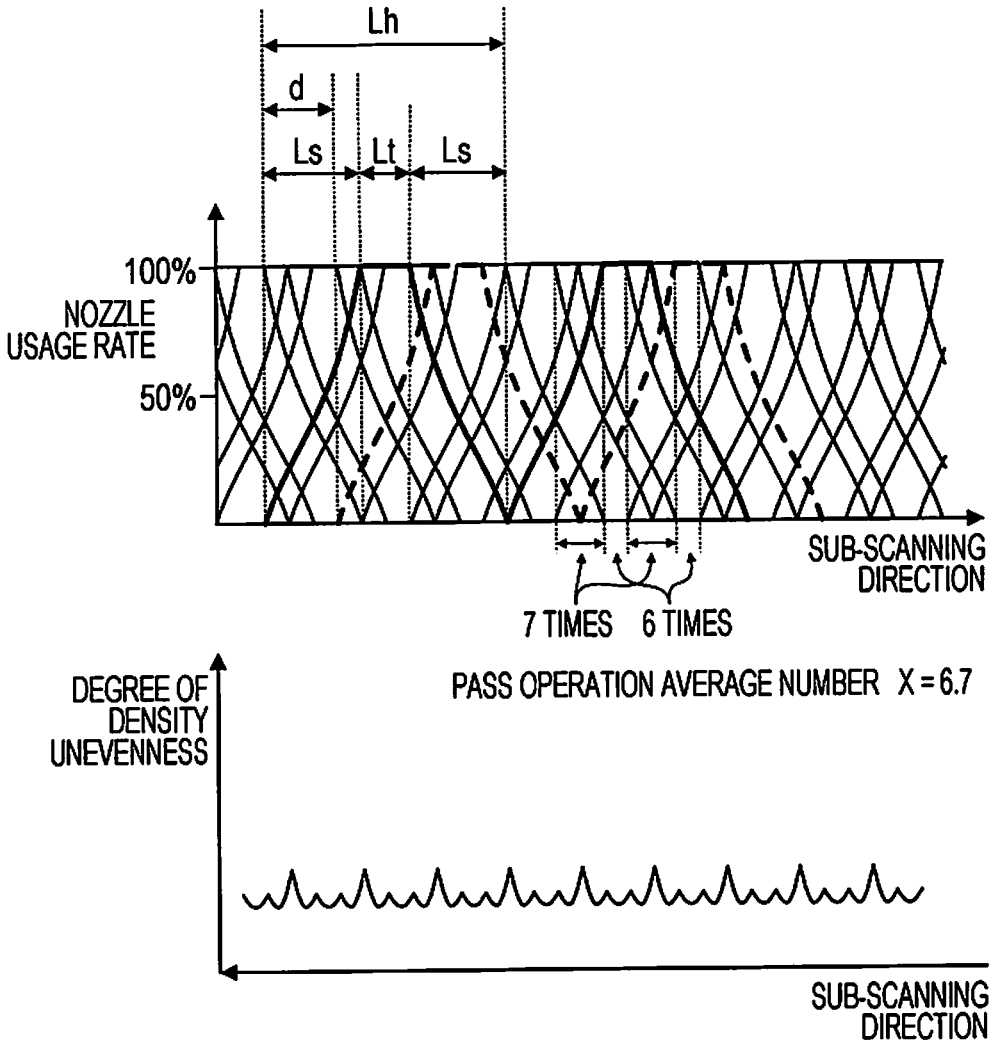
FIG. 17 is a conceptual diagram illustrating an example of a case where the degree of density unevenness is reduced.

FIG. 17 is a conceptual diagram illustrating an example of a case where the degree of such density unevenness is reduced.

The example illustrated in FIG. 17 indicates the degree of density unevenness in a case where x=6.7 by changing d.

As shown on the upper side in FIG. 17, the number of pass operations which are necessary in formation of the dot rows lined up in the main scanning direction is a part of six times and a part of seven times, and on average is 6.7 times. In addition, at the position at which two passes overlap with the nozzle usage rate close to 50%, the nozzle usage rate of a plurality of other passes of 100% overlap, and there is an action such that the reduction of density is mitigated.

As a result, as in the graph illustrated on the lower side in FIG. 17, change of density is relatively small, that is, a state is obtained in which the degree of density unevenness is smaller.

As described above, the liquid droplet discharging apparatus and the liquid droplet discharging method according to the embodiment are able to obtain the effects indicated below.

Unevenness which is confirmed in a completed image appears as a result of being combined with influence of an uneven component of an image which is formed by each pass operation is considered. In a case where a relationship between the nozzle usage rate and density of the formed image is not a linear relationship, there are cases where unevenness becomes apparent as a result of inclination being superimposed in a plurality of pass operations.

According to the embodiment, in the relationship of $Lt=4\times d\times n-Lh$, appearance of periodic unevenness is further suppressed by uneven components being superimposed in each pass operation by appropriately setting the length d at which the paper sheet 10 is relatively moved in one sub-scanning operation and n being set, and since the respective uneven components are overlapped so as to cancel each other out, it is possible to obtain printed matters on which visually recognizable unevenness is further reduced.

In addition, appearance of periodic unevenness is further suppressed by uneven components being superimposed in each pass operation by setting the length d at which the paper sheet 10 is relatively moved in one sub-scanning operation and n being set such that k<x<k+1, and since the respective uneven components are overlapped so as to cancel each other out, it is possible to obtain printed matters on which visually recognizable unevenness is further reduced.

In addition, the nozzle usage rate of the nozzles on both ends in the sub-scanning direction is the minimum nozzle usage rate within the nozzles which configure the nozzle row (first head 42A and second head 42B). By configuring in this manner, it is possible to suppress influence in an end portion region of the image which is formed in each pass operation in which influence of a feed error tends to become apparent in a case where the sub-scanning operation is performed. As a result, it is possible to obtain a printed matter on which visually recognizable unevenness is further reduced.

Note that, in the embodiment, the two of the first head 42A and the second head 42B are provided as the plurality of nozzle rows that are provided at positions which are different from each other in the sub-scanning direction, but the number of nozzle rows is not limited thereto. The number of nozzle rows may be one or the number of nozzle rows may be three or more.

This application claims priority under 35 U.S.C. §119 to Japanese Patent Application No. 2015-215513, filed Nov. 2 2015. The entire disclosure of Japanese Patent Application No. 2015-215513 is hereby incorporated herein by reference.

What is claimed is:

1. A liquid droplet discharging apparatus comprising:

a head which has nozzles that discharge liquid droplets on a recording medium;

a main scanning unit which performs a main scanning operation which relatively moves the head with respect to the recording medium in a main scanning direction; and a sub-scanning unit which performs a sub-scanning operation which relatively moves the recording medium with respect to the head in a sub-scanning direction which intersects with the main scanning direction, wherein an image consisting of a plurality of dot rows is formed on the recording medium by repetition of pass operations which form dot rows lined up in the main scanning direction by discharging the liquid droplets on the recording medium from the nozzles during the main scanning operation, and the sub-scanning operation, the nozzles are lined up in a predetermined direction which intersects with the main scanning direction to configure a nozzle row, and when a proportion of positions for which discharge of the ink droplets is possible to positions to which each nozzle can discharge the liquid droplets in one pass operation is a nozzle usage rate, the maximum nozzle usage rate in formation of the image is a maximum nozzle usage rate, a length between nozzles at both ends in the sub-scanning direction in the nozzles which configure the nozzle row is Lh, a length by which the recording medium is relatively moved in one sub-scanning operation is d, a length in the sub-scanning direction of an arrangement of consecutive nozzles with the maximum nozzle usage rate in the nozzles which configure the nozzle row is Lt, and n is a natural number, in the pass operation with respect to a predetermined region except an end portion region of the recording medium, $$Lt=4\times d\times n-Lh.$$

2. The liquid droplet discharging apparatus according to claim 1, wherein when k is a natural number and an average number of pass operations which are necessary in formation of the dot rows lined up in the main scanning direction in the predetermined region is x, $$k<x<k+1.$$

3. The liquid droplet discharging apparatus according to claim 1, wherein when the minimum nozzle usage rate in formation of the image is a minimum nozzle usage rate, a nozzle usage rate of the nozzles at the both ends is the minimum nozzle usage rate.

4. The liquid droplet discharging apparatus according to claim 1, further comprising:

a plurality of the nozzle rows, wherein the nozzle rows are provided at positions which are different from each other in the sub-scanning direction.

5. A liquid droplet discharging method comprising:

forming an image consisting of a plurality of dot rows on a recording medium by repeating a pass operation, which forms dot rows lined up in a main scanning direction by discharging liquid droplets on the recording medium from nozzles during a main scanning operation which relatively moves a head that has the nozzles which discharge the liquid droplets on the recording medium with respect to the recording medium in the main scanning direction, and a sub-scanning operation which relatively moves the recording medium with respect to the head in a sub-scanning direction which intersects with the main scanning direction, wherein the nozzles are lined up in a predetermined direction which intersects with the main scanning direction to configure a nozzle row, and when a proportion of positions for which discharge of the ink droplets is possible to positions to which each nozzle can discharge the liquid droplets in one pass operation is a nozzle usage rate, the maximum nozzle usage rate in formation of the image is a maximum nozzle usage rate, a length between nozzles at both ends in the sub-scanning direction in the nozzles which configure the nozzle row is Lh, a length by which the recording medium is relatively moved in one sub-scanning operation is d, a length in the sub-scanning direction of an arrangement of consecutive nozzles with the maximum nozzle usage rate in the nozzles which configure the nozzle row is Lt, and n is a natural number, in the pass operation with respect to a predetermined region except an end portion region of the recording medium, $$Lt=4\times d\times n-Lh.$$

6. The liquid droplet discharging method according to claim 5, wherein when k is a natural number and an average number of pass operations which are necessary in formation of the dot rows lined up in the main scanning direction in the predetermined region is x, $$k<x<k+1.$$

* * * * *